United States Patent [19]

Ivary et al.

[11] 4,331,302

[45] May 25, 1982

[54] WEB FEEDING METHOD AND APPARATUS FOR A PRINTER

[75] Inventors: David J. Ivary, Costa Mesa, Calif.; Raymond L. Kirby, Jr., Vandalia, Ohio

[73] Assignee: Monarch Marking Systems, Inc., Dayton, Ohio

[21] Appl. No.: 152,057

[22] Filed: May 20, 1980

[51] Int. Cl.[3] ..... B65H 75/18

[52] U.S. Cl. ..... 242/71.9

[58] Field of Search ..... 242/71.9, 71.8, 73, 242/118.4, 118.5, 77; 192/66, 70.19, 70.22, 70.27, 70.28, 71, 73, 99 R

[56] References Cited

U.S. PATENT DOCUMENTS

| | | | |
|---|---|---|---|
| 2,465,631 | 3/1949 | Bruestle | 242/71.9 |
| 3,017,132 | 1/1962 | Gnage | 242/71.9 |
| 3,155,016 | 11/1964 | Pellicone | 242/71.9 |
| 3,295,778 | 1/1967 | Fiorentino | 242/71.9 X |
| 3,834,643 | 9/1974 | Sauvear | 242/71.9 |
| 4,101,095 | 7/1978 | Carter | 242/71.9 |

*Primary Examiner*—Edward J. McCarthy
*Attorney, Agent, or Firm*—Joseph J. Grass

[57] ABSTRACT

There is disclosed web feeding apparatus and method for feeding a web from a web roll to a utilization device. The paying out of the web from the web roll into a U-shaped buffer loop is assisted by a pair of cooperating feed rolls which engage the web along the buffer loop. When the loop decreases to a certain extent, a sensing member causes the feed rolls to rotate to pay additional web material out of the web roll until the loop has increased to a certain extent. The web material extends from the buffer loop over the web roll and is guided to the utilization device, for example, a printer. The feed rolls can be caused to rotate when a manually engageable lever is moved in one direction. Alternatively the feed rolls can be seperated and caused to rotate when the member is moved in the opposite direction. The apparatus also includes a reel assembly having a reel for handling web rolls having a variety of different widths. The reel includes a side member slidably mounted on a shaft and clutched to the shaft at a variety of selected positions in accordance with the roll width. The apparatus also includes an arrangement for rendering the printer inoperable whenever the web roll on the reel is of a different width than the width for which the printer controls are set.

4 Claims, 7 Drawing Figures

70
71
69
120
121
81'
60
64
83
108
65
68
63
96
85
94
101
88
109
93
67
91
103
97
111
104
99
86
98
100
110
102
105
106
112
82
90
114
92
81
113
80
95
117
66'
118
66
116
107
62
61
79

93
95
120
121
60
81'
88
82
63
84
67
68
66
90
64
83
99
110
112
81
80
66'
62
86
103
102
79
113
111
105
106
107
98
65
109
97
117
108
114
118
116
115
92

FIG-4
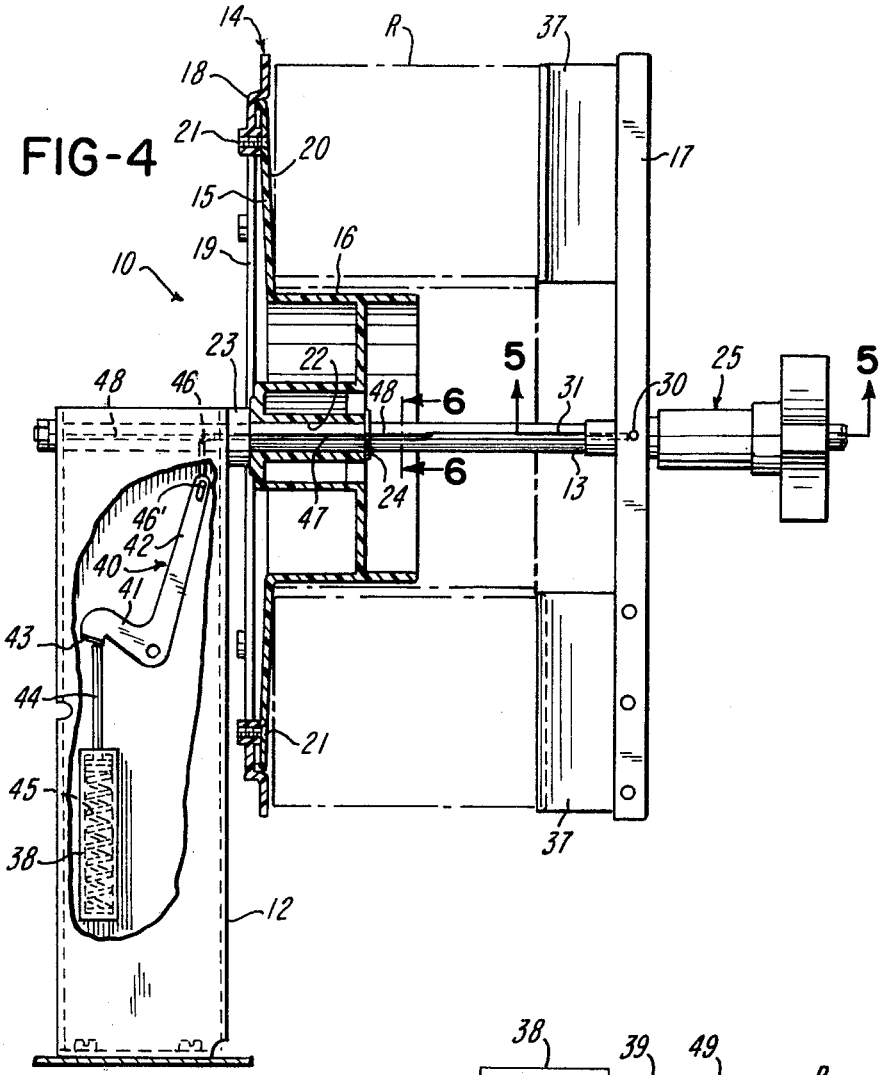
FIG-6
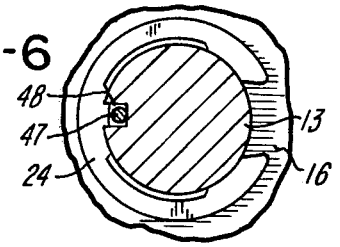
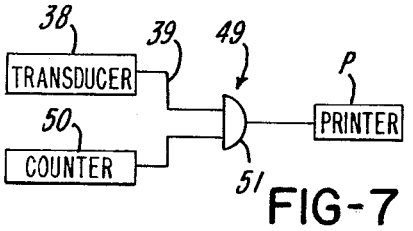
FIG-7

WEB FEEDING METHOD AND APPARATUS FOR A PRINTER

BACKGROUND OF THE INVENTION

1. Field of the Invention

This invention relates to web feeding method and apparatus.

2. Brief Description of the Prior Art

Prior art U.S. Pat. No. 3,902,412 to Robert M. Pabodie dated Sept. 2, 1975 and assigned to Monarch Marking Systems, Inc. discloses a printer having a constantly operating device for assisting the paying out of web material from a web roll. The web material is paid out of the web roll into a depending loop in which a rotary frictional feed member is disposed. Tautness in the loop will cause increased frictional force to be applied to the web with concomitant increased paying out of the web from the roll, and vice versa. The web extends from the loop over and in contact with the web roll and the web is intermittently advanced as required by the printer.

SUMMARY OF THE INVENTION

The invention relates to web feeding method and apparatus in which the web is gradually paid out of a web roll and guided to a utilization device such as a printer. The printer includes a feeding mechanism which is required to accurately position the web at a printing position and at a cutting station. In order to avoid burdening the feeding mechanism of the printer with the task of unwinding a web from a roll having considerable inertia, a simple unwinding or feeding mechanism is used to pay out the web material from the web roll. The feeding mechanism has a manually movable member to facilitate threading of a new roll quickly and easily. The mechanism for paying out the web also includes a sensing member for sensing a condition of a buffer loop in the web. When the buffer loop shortens to a predetermined extent, the drive for the unwinding mechanism is operated until the extent of the buffer loop increases to a predetermined extent as sensed by the sensing member, at which time the drive of the feeding mechanism is interrupted. The feeding mechanism according to a preferred embodiment includes a pair of cooperating feed rolls. The web in the buffer loop is received in the nip of the feed rolls. One of the feed rolls is driven and the other feed roll is mounted for movement toward and away from the driven feed roll. The separation of the feed rolls is beneficial when threading the apparatus. When a manually movable member is moved in one direction, the feed rolls are separated by a predetermined amount and the driven feed roll is rotated so that some force is exerted on the web to pay it out of the web roll. By moving the manually movable member in the other direction, the feed rolls can be driven without separating them. One roll is driven by an electric motor controlled by a switch. The switch is controlled either by operation of the sensing member alone or by operation of the manually movable member.

It is a feature of the invention to provide an improved reel assembly which can accommodate web rolls having a variety of selected widths. The reel assembly includes a reel having a hub and a first side member disposed at one side of the web. The reel also includes a second side member movably mounted on a shaft which extends through the hub. The movable side member is releasably clutched to the shaft by manually moving a member forming part of the clutch. The clutch includes a resilient member which is clutched to the shaft when the manually movable member is moved in one direction; but is unclutched from the shaft when the manually movable member is moved in the other direction to allow axial shifting movement of the side member and the clutch. The clutch is of simple construction having a first threaded member secured to the side member, a second threaded member threadably secured to the first threaded member and resilient means acted on by the first and second threaded members to engage the clutch with the shaft when the second threaded member is moved in one direction and to disengage the clutch from the shaft when the second threaded member is moved in the reverse direction.

It is another feature of the invention to control the utilization device, for example, a printer, and to indicate whether or not the web roll loaded into the reel has the correct width. In the event the web and consequently the web roll has the correct width for which the printer has been set, there will be coincidence between the setting of the printer and the width of the web roll as sensed by a transducer. In the event, however, that the web width is incorrect, this will be sensed by a transducer associated with the reel and the signal given to the printer by the transducer will not coincide with a signal corresponding to the web width for which the printer is set. Consequently, the operator of the printer will be signaled, or the printer will be rendered inoperable, or both.

BRIEF DESCRIPTION OF THE DRAWINGS

FIG. 4 is an elevational view partly in section of a reel assembly and a web-width sensing transducer arrangement;

FIG. 6 is a sectional view taken along lines 6—6 of FIG. 4; and

FIG. 7 is a diagrammatic circuit drawing showing how the transducer controls the printer.

DETAILED DESCRIPTION OF THE PREFERRED EMBODIMENT

Figures 1, 5:
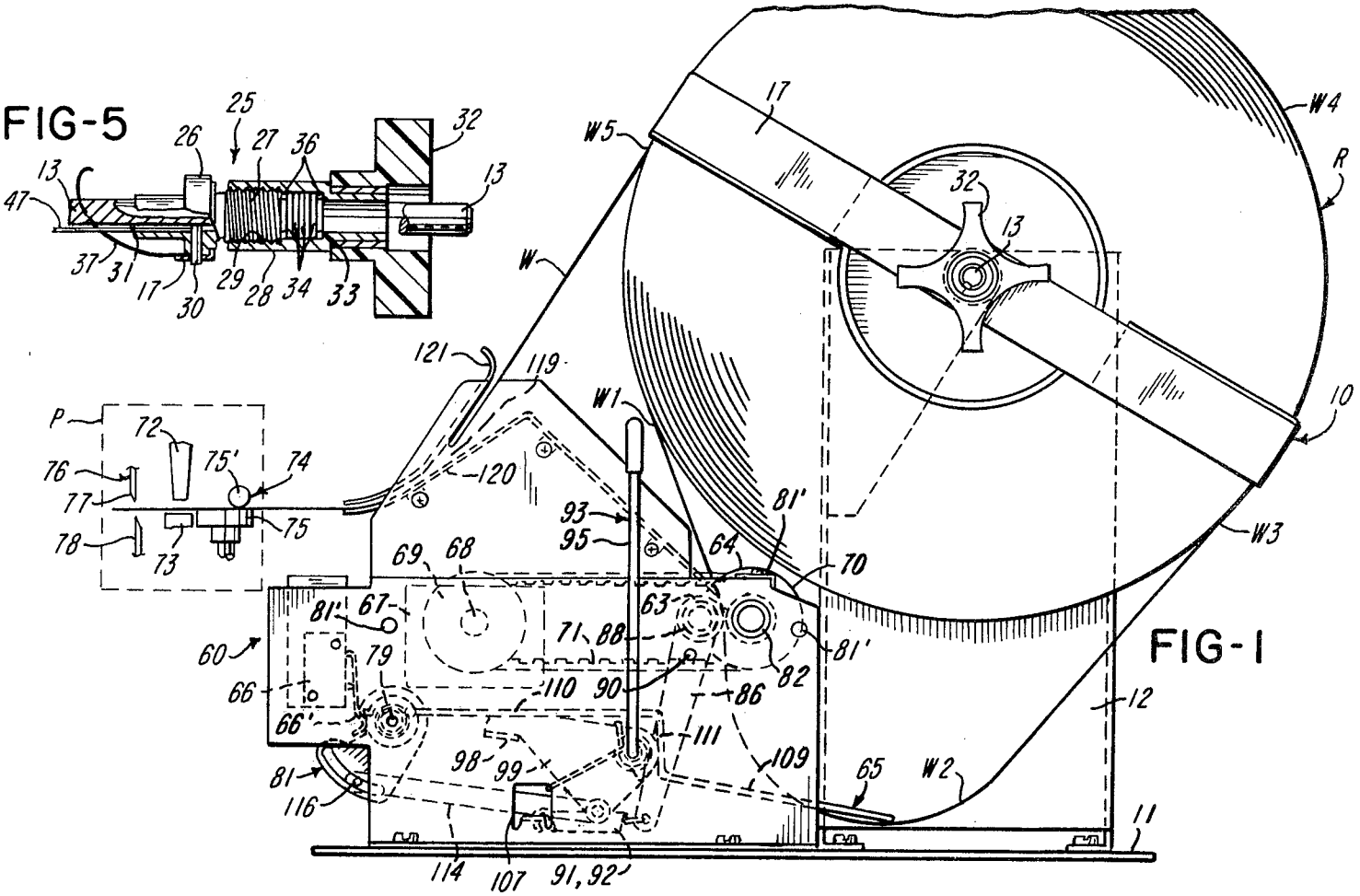
FIG. 1 is a side elevational view of a web feeding apparatus and a diagrammatically represented printer.
FIG. 5 is a rotated sectional view taken along lines 5—5 of FIG. 4.

With reference to FIG. 1, there is shown a reel assembly 10 for holding a roll R of web material W comprised of a series of connected tags or labels. The reel assembly 10 is mounted on a base 11. With reference also to FIG. 4, the reel assembly 10 includes a standard or upright support 12 which nonrotatably mounts a shaft 13. The reel assembly 10 includes a reel 14 having a composite side member 15 disposed at one side of a hub 16 and a side member 17 disposed at the other side of the hug 16. The composite side member 15 includes an annular plate 18 having an annular cutout 19 connected to an annular plate 20 by fasteners 21. The plate 20 is molded integrally with the hub 16. The hub 16 has a bore 22 for receiving the shaft 13. The hub 16 is held captive on the shaft 13 between a collar 23 and an E-ring 24 so that axial shifting of the hub 16 and the composite side member 15 is prevented. The side member 17 can be clutched to the shaft 13 at any suitable axial position by a clutch 25. With reference to FIG. 5, the clutch 25 includes a slide or clutch member 26 having an externally threaded portion 27 and a clutch member 28 having an internally threaded portion 29 threadably received by the threaded portion 27. The clutch members 26 and 28 are shown to be tubular. The clutch member 26 includes a pin or projection 30 received in an elongated slot 31 in the shaft 13. Thus, the clutch member 26 can slide axially relative to the shaft 13, but rotation of the clutch member 26 is prevented by the pin 30. The manually engageable knob 32 is secured to the outside of the clutch member 28 so that the clutch member 28 and the knob 32 rotate as a unit. The clutch member 28 has a shoulder 33. Received on the shaft 13 are a series of resilient elastomeric O-rings 34 disposed between a pair of fiber washers 36. One washer 36 abuts the terminal end of the clutch member 26 and the other washer 36 abuts the shoulder 33. By rotating the knob 32 in one direction, the clutch member 28 will urge the washers 36 toward each other and the O-rings 34 will be urged into clutching engagement with the shaft 13. Rotation of the knob 32 in the opposite direction will cause the one washer 36 to move away from the other washer 36 so that the clutch 25 and the side member 17 to which the clutch 25 is connected can move axially on the shaft 13. When the knob 32 is loosened there will be only slight frictional resistance to axial shifting of the clutch 25 provided by the O-rings 34. The side member 17 comprises a bar having a pair of spaced flexible resiliently curved leaf springs or spring members 37 which bear against the side of the web roll R. In order to place a web roll R on the reel 14, the clutch 25 and the side member 17 are slid off the end of the shaft 13. The web roll R is slid onto the hub 16 into contact with the side member 15. Then the member 17 and the clutch 25 are slid onto the shaft 13 until the members 37 are in contact with the side of the web roll R. Thereupon the knob 32 is turned to clutch the clutch 25 to the shaft 13.

A linear position transducer 38 is suitably mounted to the standard 12. A bell crank 40 pivotally mounted on the standard 12 has arms 41 and 42. Arm 41 has a flat end portion 43 which contacts a rod 44 of the transducer 38. The rod 43 is urged upwardly by a spring 45 inside the transducer 38 which normally urges the bell crank 40 in the clockwise direction. Another spring (not shown) also urges the bell crank 40 clockwise. The arm 42 is coupled to an end portion 46 of a rod 47 by a pin-and-slot connection 46'. The rod 47 is slidably received in an axially extending groove or slot 48 which is aligned with but has a lesser depth and width than the slot 31. The rod 47 is held captive by the inner periphery of the hub 16 with which it is in sliding contact. The rod 47 extends into the slot 31 and the terminal end of the rod 47 is urged into contact with the pin 30 by the spring 45 and the spring which is not shown. Thus, the width of the web roll R is sensed by the transducer 38, and width indicating signals are transmitted to the printer P via circuit 49. With reference to FIG. 7, a counter 50 is set in accordance with the width of the web W on which the printer P is to print. When gate 51 senses coincidence between the setting of the counter 50 and the width of the web W as sensed by the transducer 38, then operation of the printer P is not inhibited. Any lack of coincidence as determined by the gate 51 will render the printer P inoperable and will cause the operator to be signaled that the web W is of the incorrect width.

An unwind device generally indicated at 60 has upstanding side plates 61 and 62 mounted to the base 11. The device 60 includes a pair of rolls 63 and 64. The web W which is paid out of the roll R at W1 forms a generally U-shaped buffer loop W2 disposed in depending relationship with respect to the roll R. The buffer loop W2 again contacts the roll R at W3. The precise location of the points W1 and W3 can vary according to the extent of slackness or tautness existing in the buffer loop W2 and according to the diameter of the web roll R. From the point W3, a portion W4 of the web W extends in contact with the outer periphery or pass of the roll R for roughly 180 degrees and loses contact with the roll R at W5. Notwithstanding that portion W4 of the web W is shown in contact with the outer pass of the web W on the roll R, the portion W4 can be spaced from the outer periphery of the roll R and pass around one or more low inertia guide rollers to reduce the drag exerted by the outer pass of the web roll R.

The loop W2 passes through the nip of the rolls 63 and 64. The extent of the buffer loop W2 is sensed by a sensing member 65 which controls an on/off switch 66. The switch 66 is electrically connected to an electric motor 67. The motor 67 has a drive shaft 68 for driving a pulley wheel 69. The pulley wheel 69 drives a pulley wheel 70 through a toothed belt 71.

Figure 3:
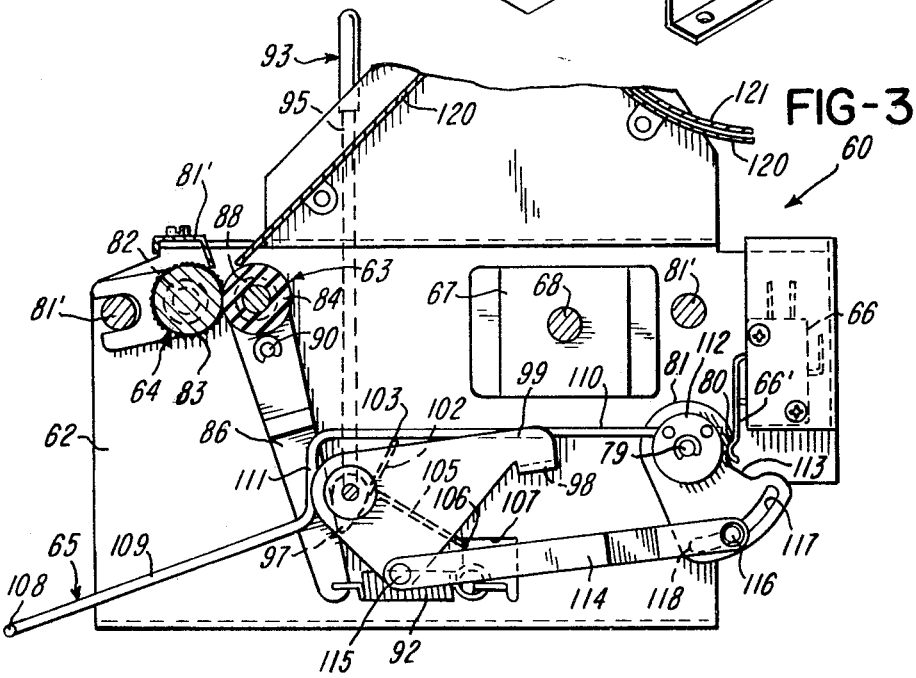
FIG. 3 is a vertical sectional view through the web feeding apparatus.

A portion of the printer P shown diagrammatically in FIG. 1 includes a print head 72 and a cooperable platen 73. An intermittent feed mechanism 74 includes a horizontally disposed feed wheel 75 which cooperates with a capstan 75' to advance the web W precisely into printing cooperation between the print head 72 and the platen 73. A suitable cutter 76 at a cutting station includes a pair of cooperating knives 77 and 78. As the web W is advanced by the feeding mechanism 74, the buffer loop W2 shortens, causing the sensing member 65 to pivot counterclockwise about a pivot 79. When the sensing member 65 has pivoted through a small arc from a position shown in FIG. 1, cam face 80 (FIG. 3) on a cam 81 causes the switch 66 to close to energize the motor 67 to pay more of the web W out of the web roll R. As the buffer loop W2 grows, the sensing member 65 pivots clockwise gravitationally to an extent that the cam 81 opens the switch 66 to deenergize the motor 67. Accordingly, the roll 64 is alternately powered to maintain the buffer loop W2 relatively slack. Accordingly, the inertia of the roll R does not affect the feeding mechanism 74 or the precise positioning of the web W for printing or severing.

Figure 2:
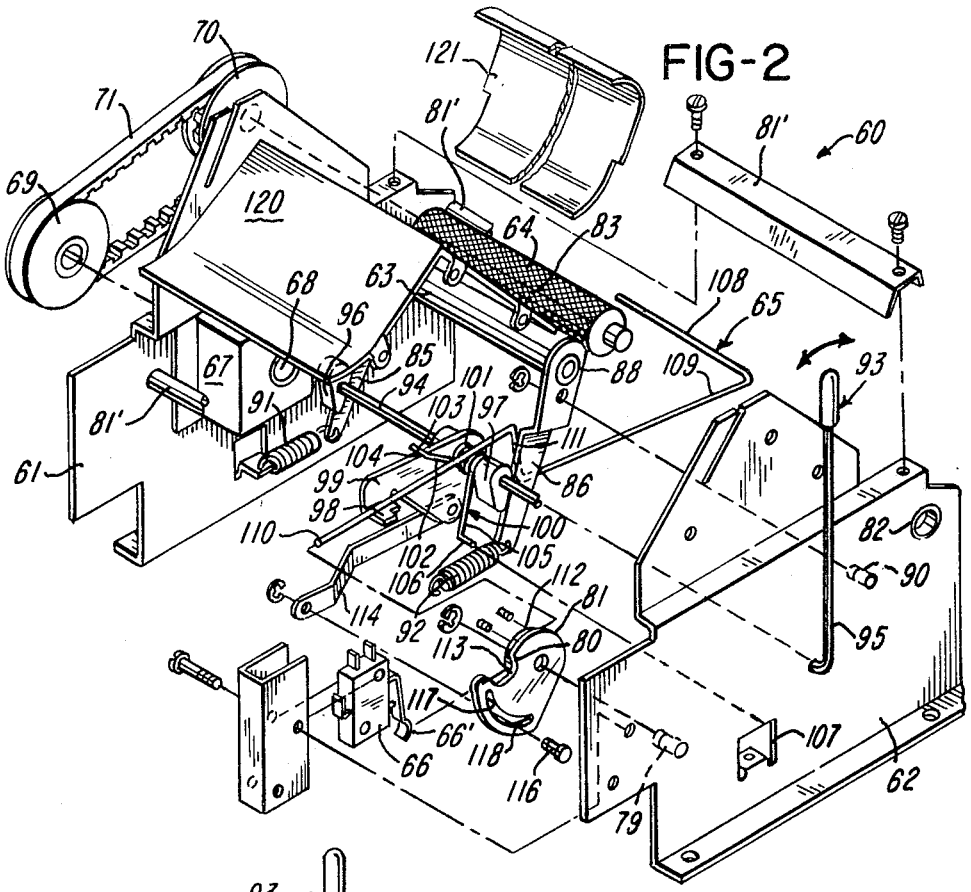
FIG. 2 is an exploded perspective view of the web feeding apparatus shown in FIG. 1.

With reference to FIG. 2, the side plates 60 and 61 are securely connected to each other by members 81'. The pulley wheel 70 is on the end portion of the roll 64. The roll 64 is driven whenever the pulley wheel 70 rotates. The roll 64 is rotatably mounted in bearings 82. The roll 64 is preferably metal and has a knurled outer surface as indicated at 83. The roll 63 has an elastomeric covering 84 and contacts the side of the web W on which the print head 72 prints. The roll 64 contacts the underside of the web W. The roll 63 is rotatably mounted at opposed end portions on levers 85 and 86 by ball bearings 88. The levers 85 and 86 are mounted on respective posts or pivots 90. Each lever 85 and 86 is biased by a respective tension spring 91 and 92 in the clockwise direction as viewed in FIG. 2. The ball bearings 87 and 88 enable the rolls 63 to skew relative to the levers 85 and 86 to accommodate to the roll 64 so there is always uniform pressure contact between rolls 63 and 64. A manually engageable movable operating member 93 has a generally L-shaped configuration and includes a pivot portion or shaft 94 and a lever portion or arm 95. The shaft 94 is pivotally mounted by the side members 61 and 62. A pair of cams 96 and 97 is secured to the shaft 94 in cooperation with respective levers 85 and 86. Operation of the movable member 93 to pivot the shaft 94 counterclockwise in FIG. 2 will pivot the levers 85 and 86 counterclockwise to move the roll 63 away from the roll 64. Pivoting of the member 93 in the opposite direction does not affect the levers 85 and 86 because the cams 96 and 97 are ineffective when the shaft 94 is pivoted clockwise in FIG. 2.

Rotation of the lever portion 95 in the clockwise direction in FIG. 2 will cause a tab or tang 93 on a lever 99 to pivot clockwise to raise the sensing member 65. Raising of the sensing member 65 will close the switch 66 to energize the motor 67. The lever 99 is rigidly secured to the shaft 94 and moves as a unit with the shaft 94. A spiral spring 100 having turns 101 received about the shaft 94 between the cam 97 and the lever 99 has an arm 102 with a tang 103 contacting the lever 99 at a point 104. The spring 100 also has an arm 105 with a tang 106 extending into a cutout 107 in the side member 62. The spring 100 biases the lever 99 and the shaft 94 in the counterclockwise direction as viewed in FIG. 2 so in the normal upright position of the lever portion 95, the tab 98 on the lever 99 does not contact the sensing member 65. The sensing member 65 has a generally horizontal sensing portion 108 connected to an elongated portion 109. The sensing portion 108 extends into the buffer loop W2 as shown in FIG. 1. The length of the sensing portion 108 enables web rolls R of various widths to be sensed. The elongated portion 109 is connected to another elongated portion 110 by a transition section 111. The portion 110 is secured to a hub 112 of the cam 81. The cam 81 has a low portion 113. The switch 66 has a switch arm 66'. When the switch arm 66' is on the low portion 113, the switch 66 is off. Because the extent of the low portion 113 is short, the switch 66 will be turned on in response to a relatively small upward movement of the sensing portion 108 of the member 65 to power the roll 64.

As is apparent, when the lever portion 95 is pivoted clockwise, the tang 98 raises the sensing member 65 to rotate the cam 91 to close the switch 66. A link 114 pivotally connected at 115 to the lever 99 and carries a pin 116 received in an elongated arcuate slot 117 in the cam 81. The pin 116 is normally in the position shown in FIG. 1. The slot 117 provides a certain amount of lost motion between the link 114 and the cam 81. When the lever portion 95 is moved counterclockwise (FIGS. 1 and 2) to a sufficient extent, the link 114 is moved to the right and the pin 116 abuts the end 118 of the slot 117 to pivot the cam 81 counterclockwise thereby closing the switch 66. In that the roll 63 starts moving away from the roll 64 almost immediately upon counterclockwise movement of the lever portion 95 (FIGS. 1 and 2), the rolls 63 and 64 will be separated to a certain extent before the switch 66 closes. This is beneficial to the operator in threading the machine in that the operator may wish to intermittently power the web W during the threading of the apparatus through the path of the web W shown in FIG. 1. Alternately, if the operator wishes to power the roll 64 without moving the roll 63 away from the roll 64, then the operator will pivot the member 95 clockwise (FIGS. 1 and 2).

As is evident, the web W is passed into a tapering throat 119 between converging plates 120 and 121. The plates 120 and 121 are held in position by the side plates 61 and 62 and guide web W into the nip of the feed wheel 75 and the cooperating capstan 75'.

Other embodiments and modifications of this invention will suggest themselves to those skilled in the art, and all such of these as come within the spirit of this invention are included within its scope as best defined by the appended claims.

We claim:

1. A reel assembly for holding rolls of web material of a variety of selected widths, comprising: a shaft, a reel mounted on the shaft, the reel having a hub adapted to receive a roll of web material, a first side member disposed at one side of the hub, a second side member disposed at the other side of the hub and mounted for axial sliding movement on the shaft to enable the second side member to accommodate rolls of different widths, means for releasably clutching the second side member to the shaft at a selected position along the shaft, and the clutching means including a manually movable member and resilient means responsive to movement of the manually engageable member for effecting clutching and unclutching.

2. A reel assembly for holding rolls of web material of a variety of selected widths, comprising: a shaft, a reel mounted on the shaft, the reel having a hub adapted to receive a roll of web material, a first side member disposed at one side of the hub, a second side member disposed at the other side of the hub and mounted for axial sliding movement on the shaft to enable the second side member to accommodate rolls of different widths, a clutch for releasably coupling the second side member and the shaft, the clutch including a first clutch member slidably mounted on the shaft, a second clutch member received about the shaft and threadably coupled to the first clutch member, and a resilient member cooperable with the first and second clutch members and clutched with the shaft when the second clutch member is turned in one direction and unclutched with the shaft when the second clutch member is turned in the opposite direction.

3. A reel assembly for holding rolls of web material of a variety of selected widths, comprising: a shaft, a reel mounted on the shaft, the reel having a hub adapted to receive a roll of web material, a first side member disposed at one side of the hub, a second side member disposed at the other side of the hub, a clutch for releasably coupling the second side member and the shaft, the shaft having a straight slot, the clutch having a first clutch member having a hole for receiving the shaft, the bar having curved resilient members for contacting the side of the web roll, the first clutch member being secured to the bar, a projection coupled to the first clutch member and received in the slot to cause the first clutch member and the bar to be guided for straight line movement but preventing rotation of the first clutch member and the bar, the first clutch member being externally threaded, a second clutch member being internally threaded and being threadably received by the first clutch member, at least one resilient O-ring for gripping the shaft when the second clutch member is turned in one direction to effect clutching, the gripping action of the O-ring on the shaft being relieved when the second clutch member is turned in the opposite direction to effect unclutching, and the second side member and the clutch being slidable on the shaft to any selected position when the clutch is unclutched to enable the curved resilient members to contact the side of a roll of a variety of different widths.

4. In combination with a reel assembly as defined in claim 3, including a plunger received in the slot, a spring for urging the plunger against the second side plate, and a transducer coupled to the rod and having an output for indicating the width of the roll on the reel.

* * * * *

UNITED STATES PATENT AND TRADEMARK OFFICE

CERTIFICATE OF CORRECTION

PATENT NO. : 4,331,302

DATED : May 25, 1982

INVENTOR(S) : Raymond L. Kirby, Jr.

It is certified that error appears in the above-identified patent and that said Letters Patent are hereby corrected as shown below:

Cover sheet, Inventors - "David J. Ivary, Costa Mesa, Calif." should be omitted. Column 2, line 61, "hug" should be --hub--. Column 5, line 14, "93" should be --98--.

Cover sheet under United States Patent item (19),"Ivary et al" should read -- Kirby, Jr. --.

Signed and Sealed this

*Third* Day of *August 1982*

[SEAL]

*Attest:*

GERALD J. MOSSINGHOFF

*Attesting Officer*

*Commissioner of Patents and Trademarks*